United States Patent [19]

Kimura et al.

[11] 4,271,894

[45] Jun. 9, 1981

[54] CONTINUOUS CASTING APPARATUS

[75] Inventors: Tomoaki Kimura; Tadashi Nishino, both of Hitachi, Japan

[73] Assignee: Hitachi, Ltd., Tokyo, Japan

[21] Appl. No.: 53,428

[22] Filed: Jun. 29, 1979

[30] Foreign Application Priority Data

Jun. 29, 1978 [JP] Japan ..... 53/79664
Mar. 16, 1979 [JP] Japan ..... 54/29893

[51] Int. Cl.[3] ..... B22D 11/06
[52] U.S. Cl. ..... 164/87; 164/432
[58] Field of Search ..... 164/87, 427–434

[56] References Cited

U.S. PATENT DOCUMENTS

| | | | |
|---|---|---|---|
| 3,627,025 | 12/1971 | Tromel | 164/429 X |
| 3,659,643 | 5/1972 | Pauels | 164/260 |
| 3,799,239 | 3/1974 | Dumont-Fillon et al. | 164/432 X |

FOREIGN PATENT DOCUMENTS

| | | | |
|---|---|---|---|
| 567318 | 12/1958 | Canada | 164/432 |
| 1090019 | 3/1955 | France | 164/432 |
| 1498360 | 10/1967 | France | 164/433 |

*Primary Examiner*—Robert D. Baldwin
*Assistant Examiner*—K. Y. Lin
*Attorney, Agent, or Firm*—Thomas E. Beall, Jr.

[57] ABSTRACT

A continuous casting apparatus includes a mold defined by a pair of side plates in a curved shape or ring-shaped rotary members and a pair of endless belts. One of the belts is inscribed in the side plates or the ring-shaped rotary members. The other belt is circumscribed with the side plates or the ring-shaped rotary members. The belts rotate in synchronism with the cast piece. On the rear surfaces of the belts, there are provided means for supporting and cooling the mold and cast piece.

13 Claims, 4 Drawing Figures

CONTINUOUS CASTING APPARATUS

BACKGROUND OF THE INVENTION

This invention relates to continuous casting apparatus for continuously casting molten metal, and more particularly to continuous casting apparatus suitable for manufacturing a thin and broad cast piece and capable of high-speed casting.

In recent years, in the field of continuous casting, it has been requested to make the casting speed high. In particular, it has been strongly desired to establish a technology for producing a broad cast piece at high speed to the utmost from molten steel which is difficult to be cooled and whose solidification speed is low. When it can be realized, the matching with the processing capabilities before and behind the casting apparatus becomes possible. This is remarkably effective, not only in reduction in the cost of equipment, the cost of maintenance etc., but also in an enhancement in the productivity, and so on.

In establishing the high-speed continuous casting technology, there are several serious hindrances. The first hindrance is the production of a solidified shell in the casting process and its attendant problems. Since the cooling time of the cast piece decreases in proportion to the raised speed, the solidified shell inevitably becomes thin. On the other hand, when the mold is made long in order to secure a sufficient cooling time, an increase in the frictional resistance with the mold and an increase in bulging as are attributed to the static pressure of the molten metal are incurred. Anyway, the high-speed casting is extremely difficult due to the limitation in strength being the rupture of the solidified shell. Needless to say, the rupture of the solidified shell makes it unavoidable to stop the casting job, and moreover, it induces an explosion accident ascribable to the contact with cooling water. It must therefore be avoided by all means. In this manner, indispensable conditions for the high-speed casting are (a) that the thickness of the solidified shell can be sufficiently secured, (b) that the frictional resistance with the mold is low, (c) that the mold can sufficiently hold the static pressure of the molten metal, etc. The second problem is a restriction which comes from the scale of casting facilities, especially the height of a building. Increases in the size of equipment and the height of the building attendant upon the raised speed form a serious hindrance in practical use.

As continuous casting apparatuses for metals, various types have hitherto been proposed. A typical example put into practical use is, as shown in U.S. Pat. No. 3,659,643, a type wherein a cast piece cooled and mold within a vibrating molded is drawn out from outside while overcoming the frictional resistance with the mold. With the continuous casting apparatus of this type, however, it is difficult to raise the speed above the present speed (2 to 3 meter/min.) on account of the restriction on the strength of the solidified shell, etc.

Synchronous continuous casting apparatuses in which a mold having wall surfaces adapted to move in synchronoism with a cast piece as means for reducing the frinctional resistance with the mold have already been proposed in various forms. In, for example, the so-called Hazelett type continuous casting apparatus wherein a mold is formed of two sets of upper and lower movable parallel belts on long latus sides of a cast piece and caterpillars on short latus sides of the cast piece, molten metal pours into the caterpillars. This often causes the rupture of a solidified shell, and involves the danger of explosion due to the leakage of the molten metal. Another serious drawback is that on account of the lowering of rigidity etc. ascribable to the temperature rise of the upper and lower parallel belts arranged rectilinearly, the belts wave to render the casting impossible. At the present time, such the type of the continuous casting apparatus is put in practical use only in the field of non-ferrous metals which are easily quenched. As synchronous continuous casting apparatus similar to the aforecited type, there has also been proposed a type wherein a mold is constructed by vertically arranging movable belts or caterpillars. With this construction, however, it is very difficult to sufficiently hold the static pressure of molten metal. Likewise to the above, there is the disadvantage that the molten metal pours into the belts or the caterpillars, so a safe casting operation cannot be performed. Moreover, on account of the vertical mold system, the building becomes high to incur an increase in the cost of equipment, and it is difficult to achieve a high speed.

SUMMARY OF THE INVENTION

An object of the present invention is to provide a novel continuous casting apparatus which is economical and which can industrially perform high-speed casting.

Another object of the present invention is to provide a novel continuous casting apparatus which is suitable for casting a thin and broad cast piece at high speed from molten metal being hard to solidify.

The present invention is characterized in that a mold is defined by a pair of members the both side ends of which are curved and parallel with each other and which form wall surfaces on short latus sides of a cast piece, and a pair of flexible endles belts touching the curved parallel ends of said members and rotating in synchronism with each other, said pair of belts forming wall surfaces on long latus sides of a cast piece, and that devices for supporting and cooling said belts are disposed in the rears of the respective belts.

According to the present invention, a mold or a casting zone is constructed in a curved shape, and the apparatus is constructed by very compact means consisting of respective pairs of side plates and belts. It is therefore possible to secure a required length for cooling a cast piece and produce a satisfactory solidified shell without making the apparatus and building large. Since the belts which move in synchronism with the cast piece are arranged on the cast-piece long latus sides which are subject to the great static pressure of the molten metal, the casting apparatus has the following advantages:

1. With a conventional mold of the slide type, the slide resistance increases with the rise of the speed, and it is subject to limitation to render the speed high (2–3 m/min). In contrast, the synchronous type can make the casting speed high because it is free from the slide resistance.

2. Since the cast piece can be taken out of the mold without slide, a force for drawing out the cast piece is unnecessary. For this reason, the troubles of rupture of the cast piece on the outgoing side of the mold decrease.

3. Owing to the absence of slide, the casting skin is finished beautiful. Oscillation marks as in the vibration mold system do not appear, either.

Unlike narrow caterpillers, the side plates on the cast-piece short latus sides can be endowed with a width enough to secure a sufficient seal area. Therefore, the seal of the contact parts of the long and short latus is always good owing to the joint use with the supporting devices in the rear of the belts. Moreover, any interstices as in the caterpillar are not existent, so that the static pressure of the molten metal can be reliably held, and that conjointly with the reduction of the cast-piece drawing-out resistance stated above, the rupture of the solidified shell and the leakage of the molten metal are avoided. In addition, since the belts are curved, the waving due to a temperature rise can be absorbed by warps in the widthwise direction of the belts. Since means for supporting static pressure of molten metal by use of water are provided in the rear sides of the belts, the mold can be uniformly cooled and supported. This results in an improvement in quality of the cast piece.

DETAILED DESCRIPTION OF THE PREFERRED EMBODIMENT

Figure 1:
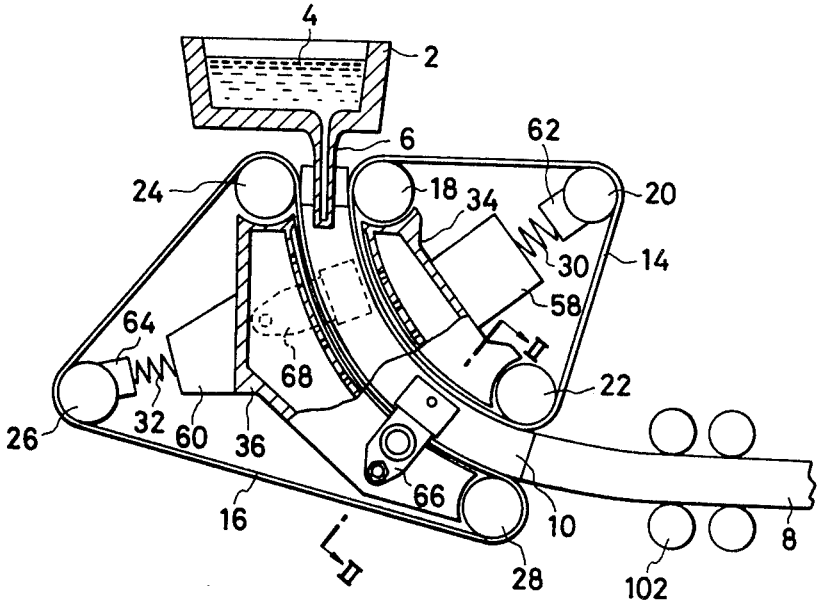
FIG. 1 is a sectional view which shows an embodiment of a continuous casting apparatus according to the present invention.
Figure 2:
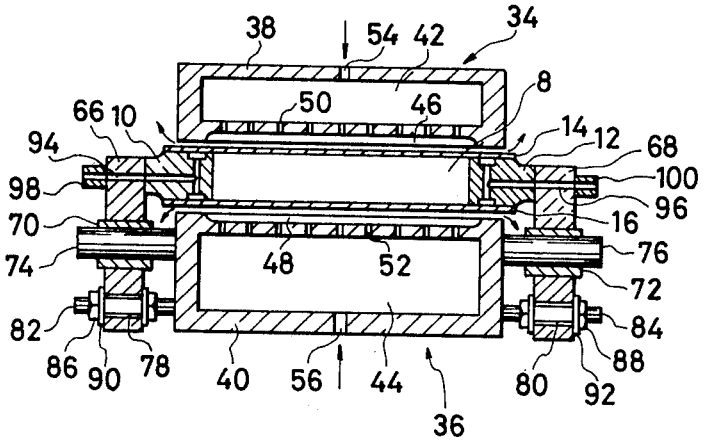
FIG. 2 is a II—II sectional view of FIG. 1, which shows means for cooling and supporting a mold.

Referring to FIG. 1 and FIG. 2, an embodiment of the present invention will be described.

Molten metal 4 in a tundish 2 is continuously poured into a mold through a nozzle 6. The short latus sides of the mold are defined by a pair of fixed side plates 10, 12 being in a curved shape so that a cast piece 8 can be molded into the curved shape. The curvature of the curve differs depending upon the scale of the apparatus, etc., and by appropriately selecting it, the apparatus can be constructed into a mold which has a cooling length as required. Assuming by way of example that the radius of curvature is 2.5 m, the length of the mold becomes approximately 4 m. On the outgoing side of the mold the curve is so set that the curvature varies gradually, making it possible to finally draw out the cast piece 8 rectilinearly. The long latus sides of the mold are defined by a pair of flexible endless belts 14, 16 which touch the curved parallel ends of the side plates 10, 12 and rotate in synchronism with each other and with the cast piece 8. The belts 14, 16 sandwich the fixed side plates 10, 12 from inner and outer sides along the curved surface. The belts 14, 16 are movably supported by rollers 18, 20 and 22 and rollers 24, 26 and 28, and they are stretched tightly by springs 30, 32, respectively. The belts 14, 16 can also be constructed so that they may be positively moved in synchronism with the cast piece by a driving device, not shown, as may be needed. In this case, it is more effective for making the tensions of the belts higher that the driving device is coupled with the rollers 22, 28 which are located in the outgoing side of the mold. The belts 14, 16 are made of soft steel.

In the rear sides of the respective belts 14, 16 which correspond to mold walls, there are disposed static pressure supporting units 34, 36 for cooling the belts 14, 16 and supporting the loads thereof. The static pressure supporting units 34, 36 are so arranged that they can support and cool the belts 14, 16 over substantially the whole region of a casting zone defined by the belts 14, 16.

The static pressure supporting units 34, 36 are fully shown in FIG. 2. FIG. 2 is a II—II sectional view of FIG. 1. Referring to FIG. 2, the static pressure supporting units 34, 36 have water chambers 42, 44 in containers 38, 40, and they are provided with pockets 46, 48 outsides the containers 38, 40 in opposition to the belts 14, 16, respectively. The water chambers 42, 44 and the poskets 46, 48 communicate through large numbers of nozzles 50, 52. During the casting, a cooling fluid under high pressure is externally introduced through inlets 54, 56 into the water chambers 42, 44. Thus, the high-pressure cooling fluid is spouted from the nozzles 50, 52 into the interspaces between the pockets 46, 48 and the belts 14, 16, and it is discharged in the widthwise direction as indicated by arrows in FIG. 2. In the flowing process, thin flowing layers of the cooling fluid are formed between the belts 14, 16 and the static pressure supporting units 34, 36, and their flow resistances generate static pressures, with which the contacts between the fixed sides plates 10, 12 and the belts 14, 16 and the support of the static pressure of the molten metal are achieved, and simultaneously, an effective cooling is performed for the belts 14, 16. The springs 30, 32 are respectively arranged between salient portions 58, 60 of the static pressure supporting units 34, 36 and roller supports 62, 64.

On the other hand, the fixed side plates 10, 12 are so constructed that they can be moved and adjusted in the widthwise direction in order to cope with changes in the width of the cast piece 8. More specifically, arms 66, 68 are secured to the fixed side plates 10, 12 in respectively two, upper and lower, places. Guides 70, 72 disposed in the arms 66, 68 are supported in a manner to be axially slidable on shafts 74, 76 which are coupled with the static pressure supporting units 34, 36. The other end parts of the arms 66, 68 are provided with holes 78, 80, in which screws 82, 84 coupled to the static pressure supporting units 34, 36 are inserted. In addition, the arms 66, 68 are fixed to the screws 82, 84 by nuts 86, 88 and washers 90, 92. By moving and adjusting the nuts 86, 88, accordingly, the widthwise positions of the fixed side plates 10, 12 can be changed. Further, lubricating apertures 94, 96 are provided in the fixed side plates 10, 12 and the arms 66, 68. They serve to supply a lubricant such as carbon to slide surfaces through feed pipes 98, 100 in order to lighten the slide resistances between the fixed side plates 10, 12 and the belts 14, 16.

The continuous casting apparatus according to the present embodiment is constructed as descrived above. Therefore, when the molten metal 4 within the tundish 2 is continously poured into the mold through the nozzle 6, the molten metal 4 is reliably received by the flexible endless belts 14, 16 supported by the fixed side plates 10, 12 and the static pressure supporting units 34, 36, without leaking out of the mold. The molten metal advances in the curved shape under a condition of a low frictional resistance in synchronism with the belts, 14, 16. In the advancing process, it is cooled by the cooling fluid from the static pressure supporting units 34, 36 and a sufficient solidified shell is formed. The resultant cast piece 8 is drawn out by pinch rollers 102. In this way, in conformity with this embodiment, a broad cast piece which is 60–200 mm thick and 900–2,000 mm wide was manufactured from molten steel which is hard to solidify. Then, the cast piece of good quality which was quite free from the leakage of the molten metal and the rupture of the solidified shell could be produced.

Figure 3:
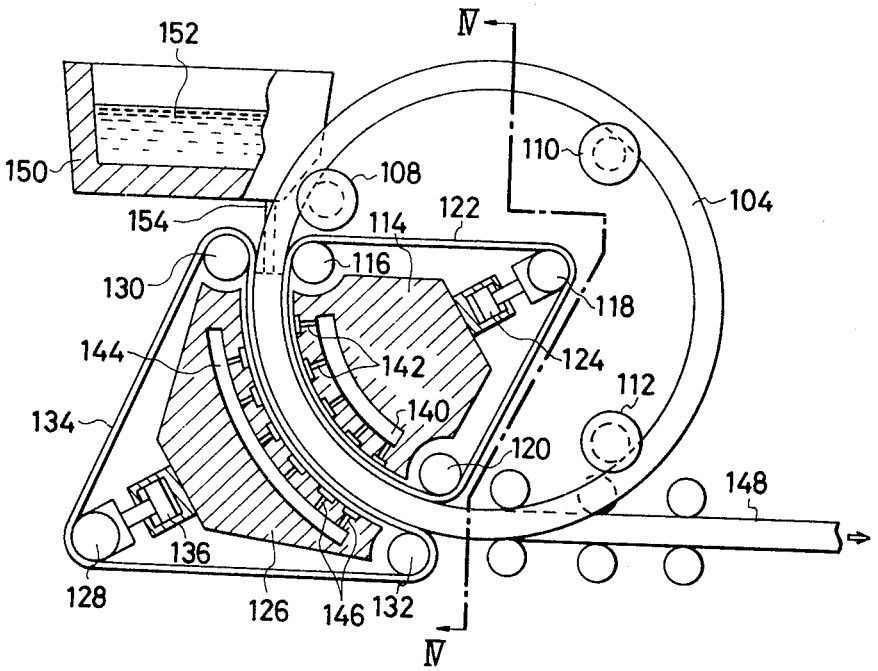
FIG. 3 is a sectional view which shows another embodiment of a continuous casting apparatus according to the present invention.
Figure 4:
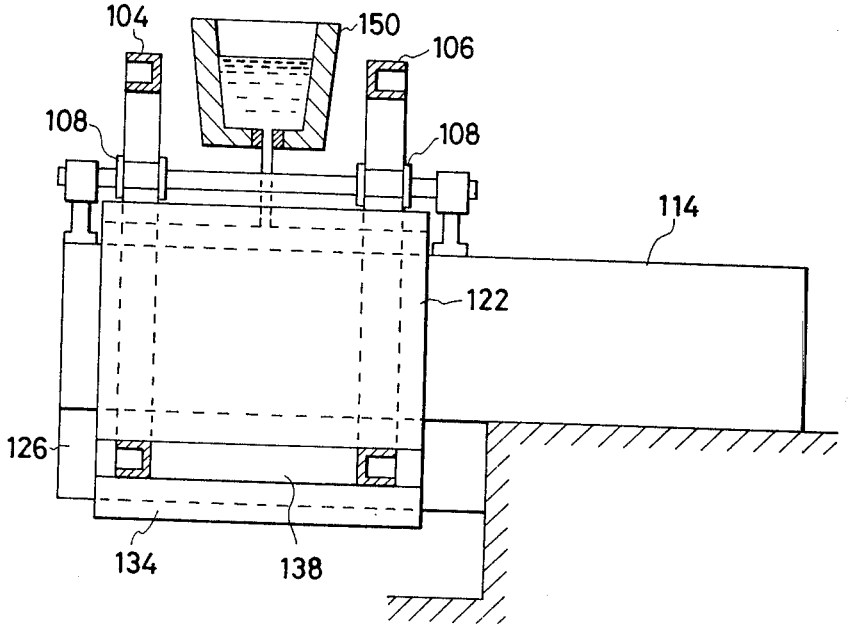
FIG. 4 is a IV—IV sectional view of FIG. 3.

Referring to FIG. 3 and FIG. 4, another embodiment of the present invention is described. The second embodiment of the present invention is characterized in that continuous casting apparatus includes a mold defined by a pair of ring-shaped rotary members which are coaxially arranged with a certain axial distance between them to form opposed wall surfaces of short latus sides of the cast piece, and a pair of endless belts which are inscribed in and circumscribed with said ring members and form wall surfaces of long latus sides of the cast piece; said ring-shaped rotary members moving in synchronism with said endless belts. In FIG. 3 and 4, a pair of ring-shaped rotary members 104, 106 are supported by a plurality of flanged guide rolles 108, 110 and driving roller 112. When the driving roller 112 rotates, the rotary members 104, 106 are rotated. A trestle 114 is arranged inside the rotary members 104, 106. On the trestle 114, guide rollers 108, 110 and driving roller 112 are pivotally supported. As shown in FIG. 3, a belt 122 is sectorally extended over the guide rollers 116, 118 and the driving roller 120. The belt 122 is arranged in a position in which its part abuts against the rear surfaces of the rotary members 104, 106. By actuating a piston 124 shown in FIG. 3, the belt 122 can apply a tension load lest the belt 122 should loosen.

On the outer side of the rotary members 104, 106, a trestle 126 is arranged as shown in FIG. 3. The trestle 126 has a construction similar to that of the trestle 114, and a plurality of guide rollers 128, 130 and driving roller 132 are pivotally supported thereon. A belt 134 is extended over the rollers 128, 130 and 132, and a belt tension can be applied by a piston 136. A mold corresponds to a space portion 138, as shown in FIG. 4, enclosed with the belt 122 which abuts against the rotary members 104, 106 from the inner side, the belt 134 which abuts against the rotary members 104, 106 from the outer side, and the inside surfaces of the rotary members 104, 106.

The trestle 114 is provided with a branched pipe 140, and is further provided with a plurality of pockets 142 communicating with the branched pipe 140. Water under pressure can be ejected from the pockets 142 towards the belt 122, whereby a thin laminar flow of cooling water is formed between the belt 122 and the trestle 114. Accordingly, the belt 122 is cooled. Besides, the belt 122 is supported in a floating state, and the contact between the belt 122 and the trestle 114 can be provented.

Likewise to the case of the belt 122, the trestle 126 is provided with a branched pipe 144 and a plurality of pockets 146, so that the belt 134 can be cooled by water under pressure and held in close contact with the rotary members 104, 106 from the outer side.

The belts 122, 134 are constructed to be endless, and are rotated by the respective driving rollers 120, 132 so as to take out a cast piece 148 in the direction of arrow in FIG. 3.

The operation of the second embodiment according to this invention constructed as above described is as follows.

In FIGS. 3, 4, molten steel 152 in a tundish 150 passes through a nozzle 154 and is fed as a stream into the mold defined by the belts 122, 134 and the rotary members 104, 106.

When the driving rollers 120, 132 are rotated, the belts 122, 134 and the rotary members 104, 106 are rotated, and they rotate in synchronism with the cast piece 148 to take out the latter. In this case, the molten steel 152 poured into the mold does not leak because the belts 122, 134 receive the water under pressure from the pockets 142, 146 and come into perfectly close contact with the rotary members 104, 106.

The mold contacts with the molten steel at high temperatures, and is an article to be consumed. It is only required to replace the belts 122, 134 and the rotary members 104, 106 which are inexpensive. The embodiment is therefore very economical and excellent in maintenance.

Also in this embodiment, as shown in FIG. 4, the width of cast piece 148 can be changed by changing the distance between the rotary members 104, 106.

According to this embodiment, a diameter of the rotary members 104, 106 is 5 to 6 meters and the casting apparatus is larger that that according to the first embodiment. However, since the rotary members 104, 106 which form the short latus side surface of the mold move in synchronism with the belts 122, 134 and the cast piece 148, there is no slide portion between the cast piece 148 and the mold. Therefore, according to this embodiment, casting is conducted at higher speed than the first embodiment. A cast piece which is 200 millimeters thick and 1500 millimeters wide is cast at least at 5 meter/min., is usual operation at 10 to 15 meters/min.

What is claimed is:

1. A continuous casting apparatus, including:

a mold defined by a pair of members having opposed side ends curved with a common curvature and parallel with each other to form casting wall surfaces of short latus sides of the cast piece, a first and a second flexible endless belts substantially touching the curved parallel ends of said members, means for rotating said belts in synchronism with each other, said first flexible endless belt forming one convex casting wall surface of long latus side of the cast piece, and said second flexible endless belt forming the other concave casting wall surface of long latus side of the cast piece.

2. The continuous casting apparatus defined by claim 1, wherein said members are fixed with respect to the rotation of said belts and supported by the apparatus, and said first and second flexible endless belts slide along the side ends of said members.

3. The continuous casting apparatus according to claim 1, wherein said members are a pair of ring-shaped rotary members axially arranged with a fixed axial spacing to form the axially opposed casting wall surfaces of short latus sides of the cast piece, said first flexible endless belt being inscribed in said ring-shaped rotary members, said second flexible endless belt circumscribed with said ring-shaped rotary members, and means for rotating said first and second flexible endless belts in synchronism with said ring-shaped members.

4. The continuous casting apparatus defined by one of claims 1 to 3, wherein said continuous casting apparatus is provided with means for supporting and cooling the mold and cast piece.

5. The continuous casting apparatus defined by claim 4, wherein each of said cooling and supporting means ejects high pressure fluid towards the rear surface of said belts opposite from said cast piece forming surfaces.

6. The continuous casting apparatus defined by claim 4, wherein each of said cooling and supporting means comprises a container for fluid provided adjacent the rear surface of the associated one of said belts having a small interspace therebetween, said container having a fluid inlet and a nozzle outlet opening towards the rear surface of the associated one of said belts.

7. The continuous casting apparatus defined by claim 6, wherein a pocket portion for fluid is provided between the nozzle and the rear surface of said belt.

8. The continuous casting apparatus defined by claim 1 or 3, wherein said members are mounted for movement towards and away from each other in the widthwise direction of the cast piece for changing the width of the cast piece.

9. The continuous casting apparatus defined by claim 3, wherein said ring-shaped rotary members are mounted for movement axially towards and away from each other in the widthwise direction of the cast piece for changing the width of the cast piece.

10. The continuous casting apparatus defined by one of claims 1 to 3, wherein each of said belts is driven and supported by at least three rollers inscribed within it.

11. The continuous casting apparatus defined by claim 3, wherein each of said ring-shaped rotary members is driven and supported by at least three rollers inscribed in said ring-shaped rotary member.

12. A continuous casting method, comprising the steps of:

providing a mold defined by a pair of members having opposed side ends curved with a common curvature and parallel with each other to form casting wall surfaces of short latus sides of the cast piece;

providing a first and a second flexible endless belts substantially touching the curved parallel ends of said members;

rotating said belts in synchronism with each other;

forming one convex casting wall surface of long latus side of the cast piece with said first flexible endless belt and simultaneously forming the other concave casting wall surface of the long latus side of the cast piece with said second flexible endless belt, with both said steps of forming occurring during said step of rotating;

sealing opposite edges of each of said belts with said members by said touching along the full length of said casting walls to form a substantially sealed tubular mold having an entrance end and an exit end for the cast piece; and pouring molten steel into said entrance end to substantially fill the mold with steel continuously during said steps of rotating and forming to continuously produce an at least partially solidified cast piece of steel from the exit end of said mold.

13. The method of claim 12, wherein said steps of providing provide the members and belts of sufficient size so that said steps of forming produce a mold of a size and shape so that said step of pouring will produce the cast steel piece in the form of a continuously produced slab.

* * * * *